US005608975A

United States Patent [19]

Hsu

[11] Patent Number: 5,608,975

[45] Date of Patent: Mar. 11, 1997

[54] COLLAPSIBLE AND PORTABLE HAIR DRYER WITH COMBUSTION HEAT SUPPLY SYSTEM

[76] Inventor: Jong-Yes Hsu, No. 31, Lane 32, Chiang Nan 10th Street, Tao Yuan Shih, Tao Yuan Hsien, Taiwan

[21] Appl. No.: 657,048

[22] Filed: May 29, 1996

[51] Int. Cl.[6] ..... A45D 00/00

[52] U.S. Cl. ..... 34/97; 34/96

[58] Field of Search ..... 34/96, 97

[56] References Cited

U.S. PATENT DOCUMENTS

| | | | |
|---|---|---|---|
| 3,846,047 | 11/1974 | Wada et al. | 414/234 |
| 4,555,232 | 11/1985 | Raccah et al. | 432/222 |
| 4,635,382 | 1/1987 | Bourdeau | 34/97 |
| 4,757,183 | 7/1988 | Karey et al. | 219/365 |
| 4,800,654 | 1/1989 | Levin et al. | 34/97 |
| 4,903,416 | 2/1990 | Levin et al. | 34/97 |
| 4,995,171 | 2/1991 | Yoshinaga et al. | 34/97 |
| 5,155,925 | 10/1992 | Choi | 34/97 |
| 5,195,253 | 3/1993 | Poumey et al. | 34/97 |

*Primary Examiner*—Henry A. Bennett
*Assistant Examiner*—Dinnatia Doster
*Attorney, Agent, or Firm*—Morton J. Rosenberg; David I. Klein

[57] ABSTRACT

A collapsible and portable hair dryer with gas combustion heat supply system is provided. Gas combustion is adapted to supply heat for air inside the hair dryer. A motor ran by a self-contained power source system is provided to rotate a fan in order to blow air through several bladelike portions, which are heated by the gas flame. Thus, the air passed through the heated bladelike portions becomes hot and is blown out for use. The hair dryer can be used outdoors because an electrical socket is not needed.

4 Claims, 5 Drawing Sheets

COLLAPSIBLE AND PORTABLE HAIR DRYER WITH COMBUSTION HEAT SUPPLY SYSTEM

BACKGROUND OF THE INVENTION

Common hair dryers are energized with electric power to produce heated air by means of a cord and plug thereof electrically connected to the power source. However, this kind of hair dryers are known to have following disadvantages:

1. The hair dryers can't be used in countries or districts where different power source voltages or types of sockets are not adapted. So the hair dryers may be useless if one carrying them in traveling should travel to such countries or districts.

2. The hair dryers can't be used outdoors for lack of power socket.

3. The hair dryers can't be used when main supply of power is cut off.

4. Wire inside the cord and plug may break through frequent movement of plugging in and unplugging the plug in use.

SUMMARY OF THE INVENTION

The present invention relates to a collapsible and portable hair dryer with gas combustion heat supply system, which comprises a main body and a handle part as the main parts. The main body houses a motor, a fan rotated by the motor and several bladelike portions therein.

The bladelike portions is arranged in front of the fan rotated by the motor, which is controlled by a motor switch and energized with an electric power source installed in the hair dryer. The bladelike portions allows air blown from the fan to pass through. A combustion chamber is provided under the bladelike portions. A heat adjustment screw is connected with a front end of the gas pipe, for one to set up a temperature value of the hair dryer. A flame nozzle is fitted in front of the heat adjustment screw. A flame guide pipe is provided, communicating with the combustion chamber, for the flame of gas under combustion to pass therethrough. The flame of gas under combustion heats up the bladelike portions to heat the air passed through the bladelike portions. The heated air is then blown out through an air outlet. A sliding rod is provided for controlling outflow quantity of gas.

A temperature sensor is installed inside the flame guide pipe, and operationally associated with both the sliding rod and the heat adjustment screw for sensing a current temperature and adjusting the current temperature in accordance with the set temperature value of the heat adjustment screw by moving the sliding rod to control the outflow quantity. Furthermore, there is provided a button on the handle part for starting the gas combustion.

BRIEF DESCRIPTION OF THE DRAWINGS

The invention will be better understood by reference to the accompanying drawings, wherein.

DESCRIPTION OF THE PREFERRED EMBODIMENTS

The present invention relates to a collapsible and portable hair dryer with gas combustion heat supply system. Gas combustion is applied to supply heat for air inside the hair dryer. A motor 14 is run by electrical power source installed inside the hair dryer to make a fan 15 rotate such that air can be passed over the gas flame and blown out.

Figure 1:
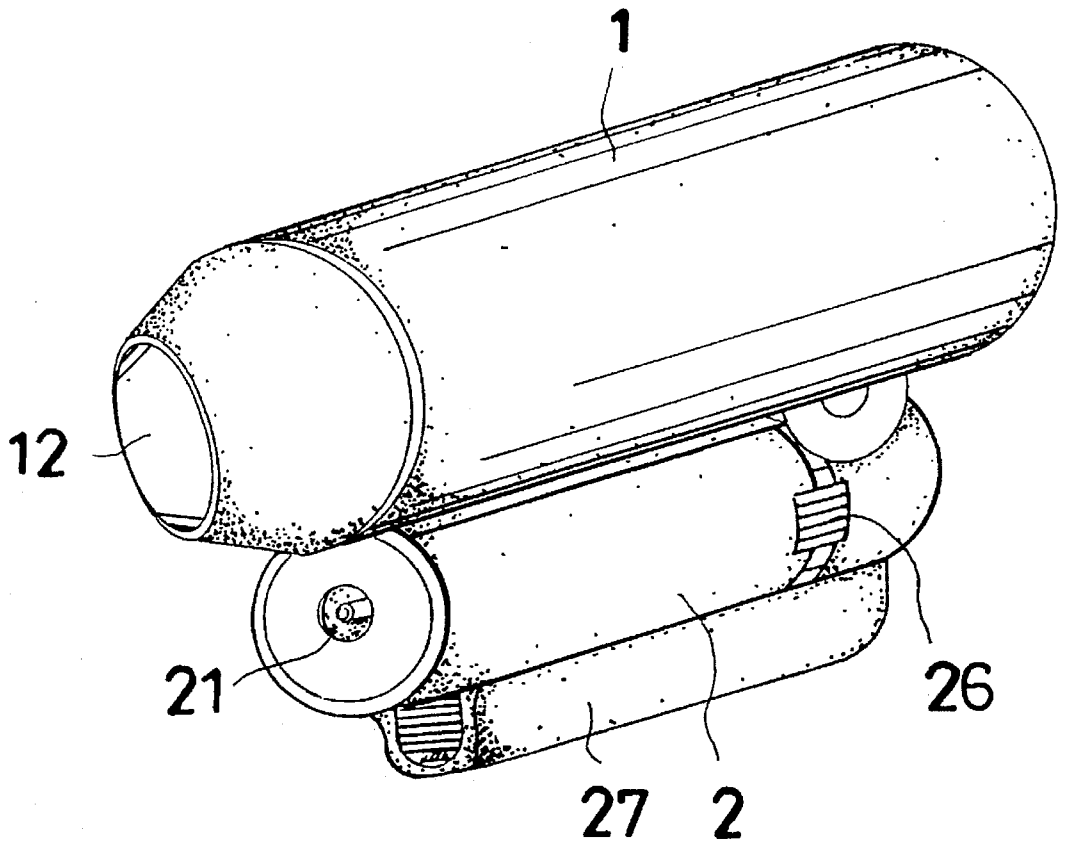
FIG. 1 is a view showing the appearance of a hair dryer according to the present invention.
Figure 2:
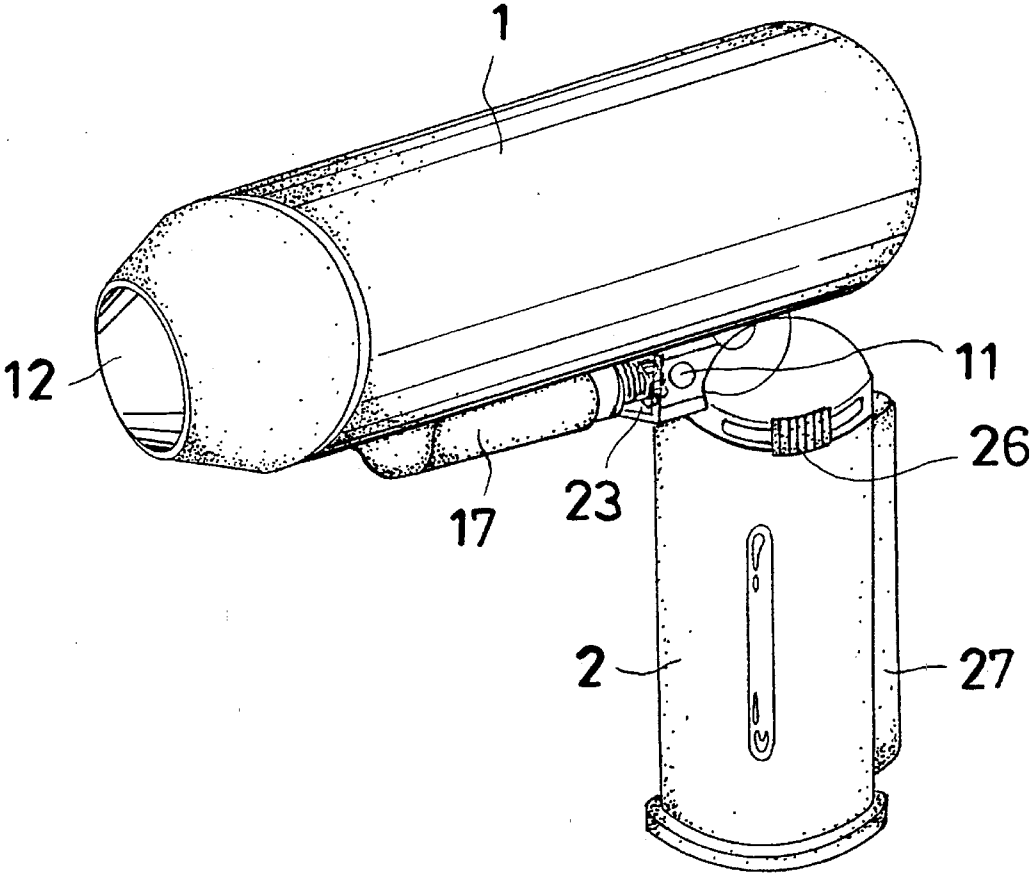
FIG. 2 is a view showing the appearance of the hair dryer of FIG. 1 with the handle part being perpendicular to the main body thereof.
Figure 3:
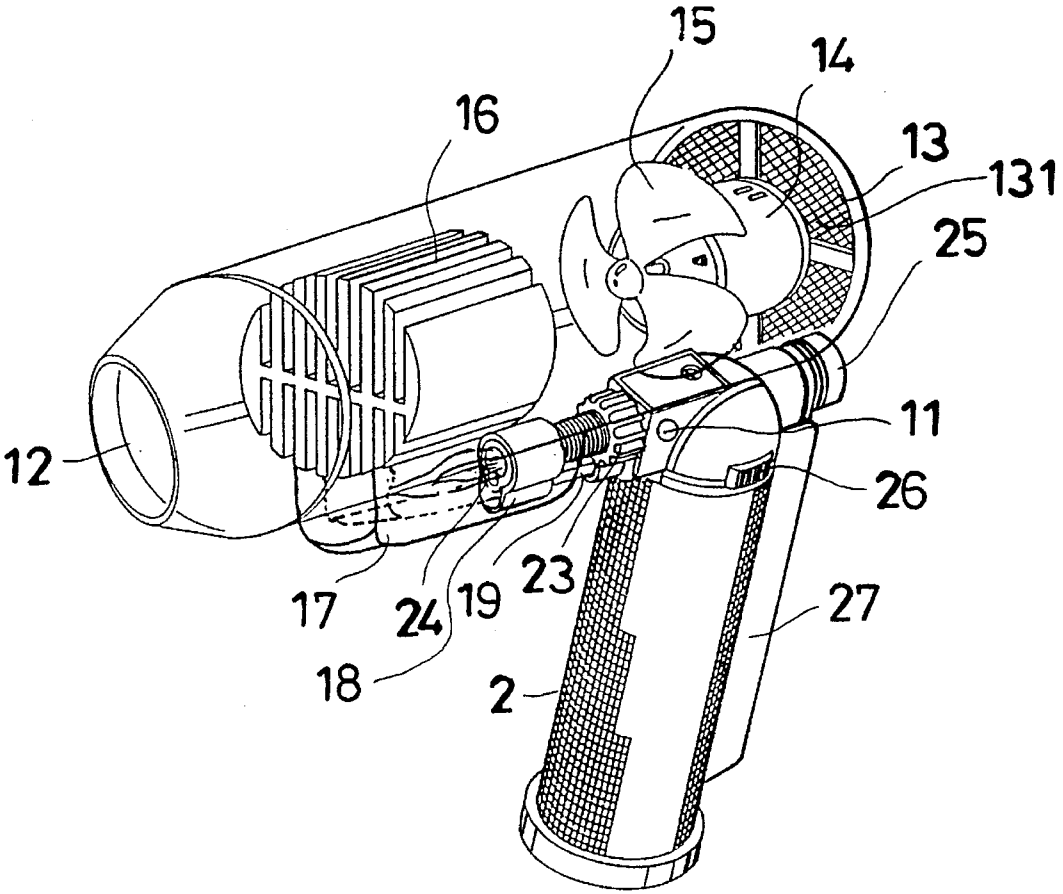
FIG. 3 is a plan of a hair dryer according to the present invention.
Figure 4:
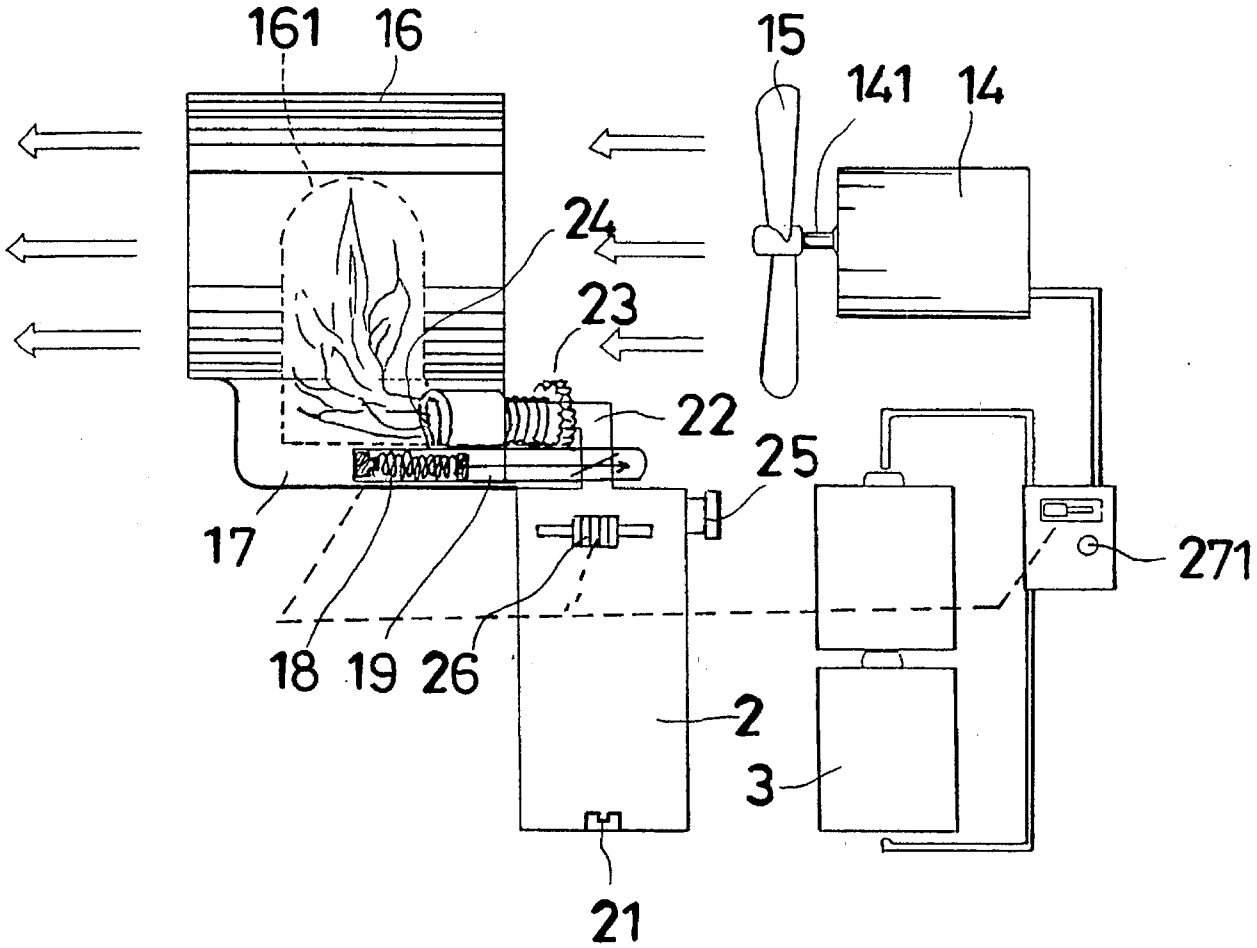
FIG. 4 is a view showing the working of the hair dryer according to the present invention; and, FIG. 5 is a view showing the structure of the bladelike portions according to the present invention.
Figure 5:
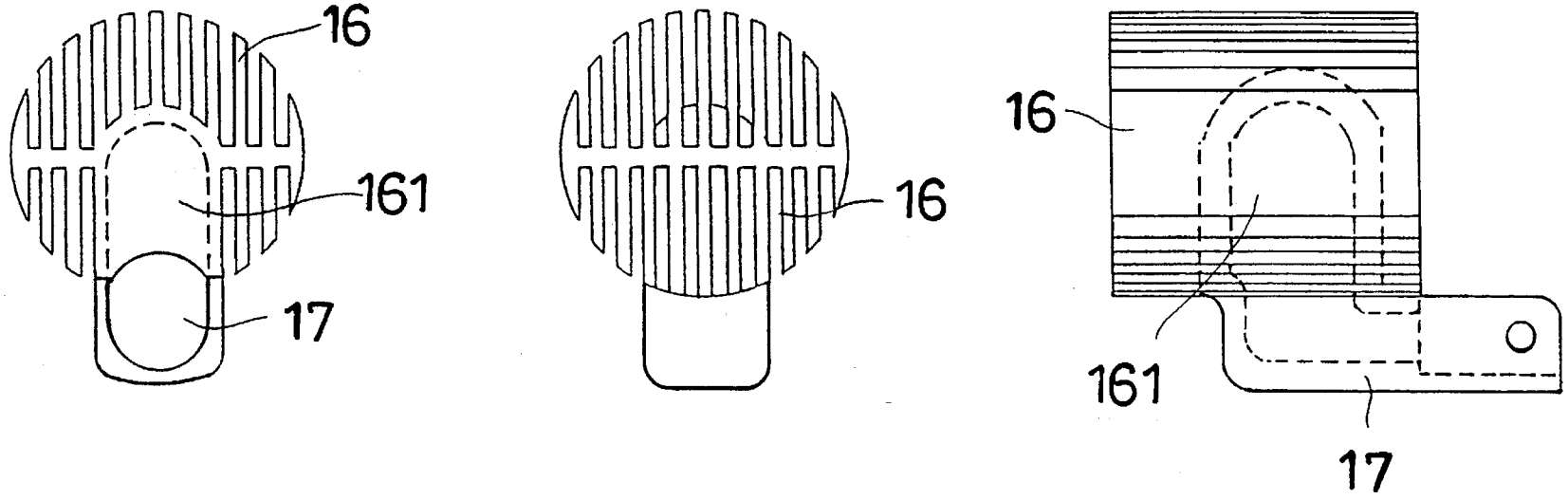

The hair dryer, referring to FIGS. 1–3, comprises a main body 1 and a handle part 2. The handle part 2 is connected to a bottom of the main body 1 by means of a pin 11 such that the handle part 2 can be pivoted to a desired position for use or transportation.

The main body 1 includes an air outlet 12 at a front end and an air inlet 13 having a net 131 at a rear end. The motor 14 is installed inside the main body and has a transmission shaft 141 to which the fan 15 is connected. Bladelike portions 16 are installed in front of the fan 15 inside the main body 1. The bladelike portions 16 are provided to absorb heat from gas combustion. A combustion chamber 161 is provided under the bladelike portions 161 for gas to be combusted therein. The combustion chamber 161 communicates with a flame guide pipe 17 provided for gas flame to pass therethrough. Furthermore, a temperature sensor 18 is installed inside the flame guide pipe 17, which sensor 18 is operationally associated with a sliding rod 19 provided to control outflow quantity of gas and a heat adjustment screw 23 to control the temperature of the hair dryer. The adjustment screw 23 is connected with a front end of a gas pipe 22 fitted on a top of the handle part 2. A flame nozzle 24 is fitted in front of the adjustment screw 23. The screw 23 is turned by the user to set a desired temperature and the temperature sensor 18 senses a current temperature to make the sliding rod 19 move forward or backward in accordance with the set desired temperature value such that the gas outflow for combustion is adapted for the user's need.

Gas is injected into the handle part 2. Also, as another embodiment, a gasholder can be used which is to be inserted into the handle part 2. A gas refilling inlet 21 is provided on a bottom of the handle part 2 for one to refill the handle part 2 with gas.

A button 25 and a motor switch 26 are provided on the handle part 2 for starting the gas combustion and the motor 14 respectively. The electrical power source of the motor 15 is housed within a holding trench 26 arranged next to the handle part 2. The power source can be a battery. Furthermore, an indicating light 271 is fitted on the handle part 2 such that the user can know whether the gas is being combusted and the motor 15 is running by means of the light 271.

In operation, the handle part 2 is pivoted to be substantially perpendicular to the main body 1, as shown in FIG. 2. Then, the motor switch 26 is pushed to start the motor 14 and simultaneously the button 25 is pushed to make gas combusted. Thus, the fan 15 rotates to draw in air through the air inlet 13 and then the air is passed through the bladelike portions 16 and the air outlet 12. The bladelike portions 16 are heated up all over by flame of the gas which is combusted within the combustion chamber 161 under the bladelike portions 16 such that the air passed through the bladelike portions 16 is heated. The heat adjustment screw 23 is turned to set a desired temperature value such that the temperature sensor 18 can control the sliding rod 19 to slide in order to adjust the gas outflow quantity in accordance with the set temperature value and the current temperature.

From the above, the hair dryer of the present invention can be understood to have advantages as follows:

1. The hair dryer has a self-contained power supply system so the user doesn't need to worry about power voltage and type of sockets of the countries where he carries the hair dryer, i.e. he can use the hair dryer around the world.

2. The handle part 2 can be pivoted for the hair dryer to be relatively compact for storage and transportation.

3. Temperature can be controlled according to need by means of the heat adjustment screw, the temperature sensor and the sliding rod.

4. The hair dryer can be refilled with gas to continue to be used by means of the gas refilling inlet on the bottom of the handle part.

5. One can know whether the gas is being combusted and whether the motor is running by means of the indicating light so the hair dryer can be used safely.

While the preferred embodiments of the invention have been described above, it will be recognized and understood that various modifications may be made therein and the appended claims are intended to cover all such modifications which may fall within the spirit and scope of the invention.

What is claimed is:

1. A collapsible and portable hair dryer with gas combustion heat supply system, in combination:

a main body housing a motor, a fan, and a plurality of bladelike portions therein;

the bladelike portions being arranged in front of the fan; the fan being rotated by the motor, which is controlled by a motor switch and energized with an electric power source installed in the hair dryer; the bladelike portions allowing air blown from the fan to pass through;

a handle part provided to hold gas therein;

a gas pipe fitted on a top of the handle part;

a combustion chamber under the bladelike portions;

a heat adjustment screw, connected with a front end of the gas pipe, for one to set up a temperature value of the hair dryer;

a flame nozzle fitted in front of 'the heat adjustment screw;

a flame guide pipe, communicating with the combustion chamber, for flame of gas under combustion to pass therethrough; said flame of gas under combustion heating up the bladelike portions to heat the air passed through the bladelike portions;

a sliding rod controlling outflow quantity of gas;

a temperature sensor, installed inside the flame guide pipe, and operationally associated with both the sliding rod and the heat adjustment screw for sensing a current temperature and adjusting the current temperature in accordance the set temperature value of the heat adjustment screw by moving the sliding rod to control the gas outflow quantity;

a button fitted on the handle part to start gas combustion;

an indicating light fitted on the handle part to indicate the gas combustion and running of the motor.

2. The collapsible and portable hair dryer with gas combustion heat supply system as recited in claim 1, wherein the handle part is inserted with a gasholder as a gas supply source.

3. The collapsible and portable hair dryer with gas combustion heat supply sytem as recited in claim 1, wherein said electric power source is a battery.

4. The collapsible and portable hair dryer with gas combustion heat supply system as recited in claim 1, wherein the handle part is pivoted onto the main body housing the motor, the fan, and the bladelike portions.

* * * * *